United States Patent [19]

Keshavan et al.

[11] Patent Number: 4,588,606

[45] Date of Patent: May 13, 1986

[54] ABRASION RESISTANT COATING AND METHOD FOR PRODUCING THE SAME

[75] Inventors: Madapusi K. Keshavan; Merle H. Weatherly, both of Indianapolis, Ind.

[73] Assignee: Union Carbide Corporation, Danbury, Conn.

[21] Appl. No.: 709,901

[22] Filed: Mar. 8, 1985

Related U.S. Application Data

[62] Division of Ser. No. 543,142, Oct. 18, 1983, Pat. No. 4,526,618.

[51] Int. Cl.[4] ..... B05D 1/08

[52] U.S. Cl. ..... 427/34; 427/423

[58] Field of Search ..... 427/34, 423

[56] References Cited

U.S. PATENT DOCUMENTS

| | | | |
|---|---|---|---|
| 2,714,563 | 8/1955 | Poorman et al. | 264/121 |
| 2,858,411 | 10/1958 | Gage | 219/75 |
| 2,950,867 | 8/1960 | Hawley et al. | 239/13 |
| 3,016,447 | 1/1962 | Gage et al. | 427/37 |
| 3,419,415 | 12/1968 | Dittrich | 427/423 |
| 4,075,371 | 2/1978 | Patel | 427/423 |
| 4,075,376 | 2/1978 | Jaeger | 427/34 |
| 4,173,685 | 11/1979 | Weatherly | 427/34 |
| 4,376,793 | 3/1983 | Jackson | 427/34 |
| 4,478,871 | 10/1984 | Sakaguchi et al. | 427/34 |

*Primary Examiner*—John H. Newsome
*Attorney, Agent, or Firm*—Norman L. Balmer

[57] ABSTRACT

A coating composition applied to a substrate by a thermal spray process which comprises tungsten carbide and a boron-containing alloy or a mixture of alloys with a total composition of from about 6.0 to 18.0 weight percent boron, 0 to 6 weight percent silicon, 0 to 20 weight percent chromium, 0 to 5 weight percent iron and the balance nickel; the tungsten carbide comprising about 78 to 88 weight percent of the entire composition.

3 Claims, No Drawings

ABRASION RESISTANT COATING AND METHOD FOR PRODUCING THE SAME

This application is a division of prior U.S. application Ser. No. 543,142, filed 10/18/83 now U.S. Pat. No. 4,526,618.

TECHNICAL FIELD

The present invention relates to abrasion resistant coatings and to a method for producing such coatings. More particularly, the invention relates to thick, crack-free, abrasion resistant tungsten carbide coatings having low residual stress which can be applied to a substrate by thermal spray techniques at relatively low cost.

BACKGROUND ART

Throughout the specification, reference will be made to plasma arc spray and detonation gun (D-Gun) techniques for depositing coating compositions. Typical deposition gun techniques are disclosed in U.S. Pat. Nos. 2,714,563 and 2,950,867. Plasma arc spray techniques are disclosed in U.S. Pat. Nos. 2,858,411 and 3,016,447. Other similar thermal spray techniques are known and include, for example, so-called "high velocity" plasma and "hypersonic" combustion spray processes.

U.S. Pat. No. 4,173,685 issued to M. H. Weatherly on Nov. 6, 1979, entitled "Coating Material and Method of Applying Same for Producing Wear and Corrosion Resistant Coated Articles" discloses the application of high density, wear and corrosion resistant coatings by depositing onto a substrate by a method capable of producing a coating having an as-deposited density greater than 75 percent theoretical, a powder composition comprising two or more components: the first component consisting of 0–25 weight percent of at least one binder taken from the class consisting of cobalt, iron, nickel and alloys thereof and at least one metal carbide taken from the class consisting of tungsten, chromium, vanadium, hafnium, titanium, zirconium, niobium, molybdenum and tantalum carbides and compounds thereof: the second component consisting essentially of a single alloy or a mixture of alloys with a total composition of 6.0 to 18.0 weight percent boron, 0 to 6 weight percent silicon, 0 to 20 weight percent chromium, 0 to 5 weight percent iron and the balance nickel: the first component comprising 40 to 75 weight percent of the entire composition. The asdeposited coating is heated at a temperature greater than 950° C. and for a period of time sufficient to cause substantial melting of the second component and reaction of the second component with a substantial portion of the first component. The coating is then cooled allowing the formation of borides, carbides and intermetallic phases resulting in a coating having a hardness greater than 1000 $DPH_{300}$ and being virtually fully dense with no interconnected porosity.

Coatings can be produced by the hereinabove described technique using either the plasma arc spray or detonation gun (D-Gun) deposition processes.

SUMMARY OF THE INVENTION

It has been surprisingly discovered in accordance with the present invention that superior abrasion resistant coatings can be produced according to deposition methods similar to that disclosed in the Weatherly patent, supra, if the first component is tungsten carbide and the second component consists essentially of a single alloy or a mixture of alloys with a total composition of about 6.0 to 18.0 weight percent boron, 0 to 6 weight percent silicon, 0 to 20 weight percent chromium, 0 to 5 weight percent iron and the balance nickel, the first component comprises about 78 to 88 weight percent of the entire composition, and if the heat treatment and cooling steps to densify the coating are essentially eliminated.

The powder composition can be applied to the substrate using the plasma spray process in the form of relatively thick coatings having very low residual stress. The coatings do not readily crack or spall, they can be applied to a variety of substrates at fairly low cost and have good finishability.

DESCRIPTION OF THE PREFERRED EMBODIMENTS

The coatings of the present invention are applied to a substrate using a conventional thermal spray technique. In the plasma arc spray technique, an electric arc is established between a non-consumable electrode and a second non-consumable electrode spaced therefrom. A gas is passed in contact with the non-consumable electrode such that it contains the arc. The arc-containinq gas is constricted by a nozzle and results in a high thermal content effluent. Powdered coating material is injected into the high thermal content effluent nozzle and is deposited onto the surface to be coated. This process and the plasma arc torch used therein are described in U.S. Pat. No. 2,858,411. The plasma spray process produces a deposited coating which is sound, dense and adherent to the substrate. The deposited coating also consists of a regularly shaped microscopic splats or leaves which are interlocked and mechanically bonded to one another and also to the substrate.

The powdered coating material used in the plasma arc spray process may have essentially the same composition as the applied coating itself. With some plasma arc or other thermal spray equipment, however, some changes in composition are to be expected and in such cases the powder composition may be adjusted accordingly to achieve the coating composition of the present invention.

Preferably, the powder composition is a mixture consisting essentially of 80 weight percent WC and 20 weight percent NiB. The tungsten carbide is essentially a pure tungsten monocarbide of near theoretical carbon content with a mean particle size of 10–12 microns. As used herein, "NiB" represents an alloy having the following approximate composition:

15.0–18.0 weight % B; 0–3.0 weight % Fe; balance Ni.

Another preferred powder mixture for use in depositing coatings of the present invention consists of essentially 85 weight percent WC+10 weight percent NiB+5 weight percent BNi-2. Again, WC is essentially pure tungsten carbide. As used herein, "BNi-2" represents an alloy having the following approximate composition:

2.5–3.5 weight % B; 2.0–4.0 weight % Fe; 6.0–8.0 weight % Cr; 3.0–5.0 weight % Si; balance Ni.

The powders used in the asma arc spray process according to the present invention may be cast and crushed powders. However, other forms of powders such as sintered powders may also be used. Generally, the size of the powder should be about −325 mesh. Pit-free coatings, however, can be achieved by using vacuum premelted and argon atomized NiB powder sized to −325 mesh +10 micron instead of cast and crushed NiB powder. Torch life is also significantly improved.

The coatings of the present invention may be applied to almost any type of substrates, e.g., metallic substrates such as iron or steel or non-metallic substrates such as carbon or graphite, for instance. Some examples of substrate material used in various environments and admirably suited as substrates for the coatings of the present invention include, for example, steel, stainless steel, iron base alloys, nickel, nickel base alloys, cobalt, cobalt base alloys, chromium, chromium base alloys, titanium, titanium base alloys, refractory metals and refractory-metal base alloys.

The microstructure of the coatings of the present invention are very complex and not completely understood. However, the predominant phases were identified by X-ray diffraction techniques and were determined to be alpha ($W_2C$), beta ($WC_{1-X}$) and eta ($Ni_2W_4C$) phases. Small percentages of some nickel boride phases may be present but could not be positively identified. The specimens tested showed only a few angular carbides indicating good melting and/or reaction during the coating. The polished and etched specimen showed a surprisingly high degree of homogenity considering that the coating is made from blended powders.

The coatings of the present invention can be deposited onto a substrate using a plasma arc spray in relatively thick layers in excess of 0.080 inch thickness in the case of coatings prepared from 80 weight percent WC+20 weight percent NiB. The maximum thickness of coatings prepared from powders of WC+10 weight percent NiB+5 weight percent BNi-2 is about 0.030 inch. The coatings are deposited with very low residual stress and consequently, they do not crack or spall after deposition. Moreover, the coatings can be applied at fairly fast deposition rate and their cost are moderately low.

Another advantage of the present invention is that the coatings can be deposited with a very smooth surface. Consequently, a clean ground surface can be obtained by grinding the as-deposited coating down about only 0.005 inch or less.

A number of coating specimens were prepared in accordance with the present invention and tested for abrasion wear, erosion and hardness. The specimens were prepared by plasma arc spray using powders of WC and both NiB and BNi-2 alloys in varying proportions on substrates of AISI 1018 steel. The abrasion tests were conducted using standard dry sand / rubber wheel abrasion tests described in ASTM Standard G65-80, Procedure A. The erosion tests were also conducted according to standard procedures using two different impingement angles of 90° and 30°. The results of these tests are tabulated in Table I below.

TABLE I

| NiB(w/o) | BNi-2(w/o) | Sand Abrasion Wear Rate (6000 Rev) $mm^3$/1000 Rev. | Erosion Rate (μm/gm) 90° | Erosion Rate (μm/gm) 30° | Hardness ($kg/mm^2$) | Porosity[2] % |
|---|---|---|---|---|---|---|
| 36.5 | 0 | 1.85 | 234.6 ± 0.0 | 32.0 ± 1.4 | 834 ± 85 | 1.0 |
| 36.5 | 0 | 1.81 | | | | |
| 10 | 0 | 1.89 | 208.4 ± 12.6 | 29.2 ± 1.12 | 899 ± 113 | 1.5 |
| 10 | 0 | 1.81 | | | | |
| 10 | 0 | 1.85 | 232.5 ± 5.23 | 26.2 ± 0.75 | 943 ± 107 | 1.5 |
| 10 | 0 | 1.81 | | | | |
| 10 | 10 | 1.55 | 172.4 ± 0.0 | 32.9 ± 0.28 | 984 ± 74 | .5 |
| 10 | 10 | 1.59 | | | | |
| 0 | 20 | 1.71 | | (1) | 903 ± 63 | 0.5 |
| 0 | 20 | 1.69 | | | | |
| 18.25 | 18.25 | 1.97 | 154.8 ± 4.9 | 29.2 ± 2.6 | 848 ± 55 | 1.75 |
| 18.25 | 18.25 | 1.97 | | | | |
| 5 | 5 | 1.98 | 213.8 ± 14.1 | 22.4 ± 2.1 | 967 ± 47 | 1.0 |
| 5 | 5 | 2.02 | | | | |
| 10 | 5 | 1.67 | 171.6 ± 1.6 | 23.4 ± 0.8 | 943.5 ± 100 | 1.0 |
| 10 | 5 | 1.71 | | | | |
| 10 | 5 | 1.54 | 195.9 ± 2.9 | 21.8 ± 0.4 | | |
| 10 | 5 | 1.49 | | | | |
| 10 | 5 | 1.49 | 158.7 ± 5.7 | 25.3 ± 1.5 | | |
| 20 | 0 | | 205.7 ± 4.38 | 36.9 ± 6.0 | 974 ± 45 | 0.5 |
| 20 | 0 | 1.46 | 240.4 ± 7.8 | 27.6 ± 1.5 | 915 ± 70.4 | 1.75 |
| 20 | 0 | 1.43 | 197.4 ± 1.7 | 24.8 ± 0.7 | | |
| 20 | 0 | 1.43 | | | | |
| 20 | 0 | 1.53 | 183.4 ± 2.5 | 26.8 ± 3.3 | | |
| 20 | 0 | 1.55 | | | | |

(1)Not thick enough for erosion test.
(2)Apparent metallographic porosity

It will be seen from Table I that coatings made from powder mixtures of WC+20 weight % NiB and WC+10 weight % NiB +5 weight % BNi-2 have similar wear rates, hardness and porosity values. Various other compositions that were tested showed higher abrasion wear rates. Coatings with no BNi-2 had higher erosion rates for 90° angle test. Apparent porosity in all cases was less than 2%. The coatings made from powder mixtures of WC 20 weight % NiB and WC+10 weight % NiB+5 weight % BNi-2 showed the best combination of abrasive and erosive wear rates. The major difference between the two compositions is that the former can be deposited to a greater thickness (e.g., over 0.080 inch) without cracking or spalling.

We claim:

1. A method for producing an abrasive resistant coating on a substrate which comprises: providing a powder composition comprising tungsten carbide and a boron-containing alloy or a mixture of alloys with a total composition of from about 6.0 to 18.0 weight percent boron, 0 to 6 weight percent silicon, 0 to 20 weight percent chromium, 0 to 5 weight percent iron and the balance nickel; the tungsten carbide comprising about 78 to 88 weight percent of the entire composition; and then depositing the powder composition by plasma arc spray onto said substrate.

2. A method according to claim 1 wherein the powder composition comprises about 80 weight percent tungsten carbide and 20 weight percent of a boron-containing alloy consisting essentially of about 83% nickel and the balance boron.

3. A method according to claim 2 wherein the powder composition comprises about 85 weight percent tungsten carbide, a first boron-containing alloy consisting essentially of about 83 weight percent nickel and the balance boron and a second boron-containing alloy consisting essentially of about 2.5 to 3.5 weight percent boron, 2.0 to 4.0 weight percent iron, 6.0 to 8.0 weight percent chromium, 3.0 to 5.0 weight percent silicon and the balance nickel.

* * * * *